United States Patent [19]

Marocco

[11] 4,092,393

[45] May 30, 1978

[54] METHOD OF MAKING BLOCKS AND PLATES FROM PIECES OF MARBLE AND OTHER NATURAL STONES

[75] Inventor: Giuseppe Marocco, Turin, Italy

[73] Assignee: Soberman Establishment, Balzers, Liechtenstein

[21] Appl. No.: 658,968

[22] Filed: Feb. 18, 1976

[30] Foreign Application Priority Data

Feb. 20, 1975 Italy ..... 67442 A/75

[51] Int. Cl.[2] ..... B28B 23/22

[52] U.S. Cl. ..... 264/102; 264/152; 264/261; 264/277

[58] Field of Search ..... 264/102, 152, 261, 277

[56] References Cited

U.S. PATENT DOCUMENTS

| | | | |
|---|---|---|---|
| 1,912,401 | 6/1933 | Renouprez | 264/152 X |
| 3,177,273 | 4/1965 | Fingerhut | 264/277 X |
| 3,413,391 | 11/1968 | Carroll | 264/102 |
| 3,420,925 | 1/1969 | Sharif | 264/102 |
| 3,481,810 | 12/1969 | Waite | 264/261 X |
| 3,700,533 | 10/1972 | Schmitz | 264/277 X |
| 3,822,336 | 7/1974 | Hazelwood | 264/261 |
| 3,875,278 | 4/1975 | Brandt | 264/102 X |
| 3,993,813 | 11/1976 | Grieco | 264/261 |

FOREIGN PATENT DOCUMENTS

| | | | |
|---|---|---|---|
| 491,397 | 9/1938 | United Kingdom | 264/277 |

*Primary Examiner*—Thomas P. Pavelko
*Attorney, Agent, or Firm*—Sughrue, Rothwell, Mion, Zinn and Macpeak

[57] ABSTRACT

Pieces of marble or similar natural stone having a plurality of plane faces are stacked in a liquid-tight container. Said pieces are arranged with their plane faces facing each other so as to form a plurality of parallel layers. Thereafter, a vacuum is applied in said container and, while maintaining the latter under vacuum, a fluid hardenable binding composition, such as a synthetic resin, is then poured into said container. Said composition flows down through the interstices existing in and around the stack of pieces, until it completely covers said stack. Thereafter, the inside of the container is brought to atmospheric or superatmospheric pressure, thus causing said binding composition to thoroughly penetrate into all said interstices and into all the cavities of the pieces opening on their surface, and then said binding composition is allowed to harden.

10 Claims, 7 Drawing Figures

METHOD OF MAKING BLOCKS AND PLATES FROM PIECES OF MARBLE AND OTHER NATURAL STONES

The present invention relates to the working of stone materials and more particularly to a method for the production of blocks from pieces of marble and similar natural stones.

It is known that marbles and natural stones in general are raw materials which do not lend themselves readily to economic industrial working because of the numerous waste materials produced in all the treatment steps, from quarry extraction to the obtaining of slabs or other finished products.

An important step forward in the process of industrialization of the working of marble and other stones in general has been made with the so-called conglomerated or agglomerated marbles. Conglomerated marbles have the great economic advantage of being produced from a very economic raw material, such as small size quarry waste materials. With the advance in the technology of production of conglomerated marble, some quarries have been specifically equipped for the extraction of material not in the form of blocks, but in the form of small stones. The small stones are first crushed to different sizes and then introduced in metered proportions into a mixer with the addition of powdered calcium carbonate and of a hardenable binder in the fluid state, which may be cement-based, resinous or of another type. According to the more sophisticated prior art, described in German Patent application DT-OS No. 2,246,770, the mixture of fluid binder and small stones is introduced into a form having the dimensions of the block to be obtained, which is caused to rotate in the interior of an autoclave under vacuum. Thus, uniform distribution of the various components of the batch is improved and the batch is in part freed from absorbed air bubbles. The contents of the form is then vibrated and allowed to harden in the autoclave.

This method, which permits to obtain conglomerated marble blocks having the required regular dimensions, even very large dimensions, and thus suitable for cuttin into slabs, presents, nevertheless the following drawbacks:

The distribution of the small stones of different sizes in the mixture is wholly random, as a result of which there is no certainty that, in the succeding sectioning of the block into slabs, the small stones are sectioned in parts of form and dimensions such as to be firmly anchored in the contiguous slabs. On the contrary, it very frequently happens that, upon sectioning, small fragments of stone which, because of their form, are not sufficiently anchored and which can be quickly detached, or else small fragments of stone so thin as to rapidly disappear through wear, remain embedded on the surface of the slabs.

The cohesion of the conglomerated material is inferior to that of natural stone, because it is imparted almost exclusively by the binder which bridges the various fragments of natural stone; further, given the lack of mechanical anchorage between the various fragments, an anchorage which is always produced by the binder, the relieving of internal stresses due to the hardening of the binder can subsequently produce distortion of the slabs.

Vacuum is applied after the mixture has been introduced into the form. The mixture, being very dense, cannot be degassed completely, and the entrapped residual air bubbles produce surface imperfections on the slabs obtained from the block. Further, the density of the mixture impedes perfect sealing of the interstices between the various pieces and in particular their surface cavities.

With a process according to the prior art such as that above described, it is therefore difficult to obtain good structural and aesthetic results and, in many applications, conglomerated products cannot compete with natural materials.

An object of the present invention is that of producing blocks of standardized dimensions which can be used industrially in mass production processes with constant production costs and without inconveniences, to obtain final products free from internal or external defects and necessitating no stoppering, while maintaining or even raising the technical and aesthetic characteristics of the material used.

According to the present invention, this object is achieved by means of a method which comprises the following series of the steps:

a. providing a plurality of pieces of marble or similar natural stone having a plurality of plane faces, at least two of which are parallel to each other;

b. stacking said pieces in a container having internal shape and dimensions corresponding to those of the block to be obtained and whose side walls and bottom wall are liquid-tight, said pieces being arranged with their plane faces facing each other, so as to form a plurality of parallel layers, each layer being delimited by a plurality of said plane faces;

c. applying vacuum in said container;

d. pouring into said container, while maintaining the latter under vacuum, a fluid hardenable binding composition so that said composition flows down through the interstices between one piece and another and between the pieces and the side walls of the container until it completely covers said pieces;

e. bringing the inside of the container to atmospheric or superatmospheric pressure, thus causing said fluid binding composition to thoroughly penetrate into all said interstices, including those caused by the roughness of said plane faces, and into all the cavities of the pieces opening on the surface of said pieces;

f. allowing said binding composition to harden; and g. removing from said container the thus consolidated block formed by the pieces and hardened binding composition.

From the structural point of view, the block obtained by the method according to the present invention and the finished products, such as slabs, which can be produced therefrom, have a coherence greatly superior to that of a conventional conglomerate. In fact, as the interstices between one piece and another are defined for the greater part by plane interfaces along which the pieces are juxtaposed, the amount of binding composition which impregnates the block is very small with respect to that of the stone material. The mechanical strength of the product depends almost exclusively on the stone material and not on the binding composition, which does not bridge the different pieces one to another, but only provides "gluing" between them. The weakness of a very defective piece is therefore compensated for by adjacent pieces, and this is more true the smaller the pieces. On the surface of the cut slabs there do not, thus, exist fragments liable to come off.

Further, in the method there is employed a binding composition in a very fluid state which, beyond bonding the pieces together, fills all the cavities (cracks, alveoli, etc.) which are present on the surface. The application of vacuum before and not after the gluing of the binding composition avoids the danger of imperfections due to entrapped air bubbles and further guarantees the perfect drying of the pieces and, when the binding composition is a resin, also degassing of the latter.

Especially if the binding composition is a hardenable resin, its polymerization or hardening takes place substantially without unbalances or generation of internal stresses, on account of the fact that the resin is substantially distributed along a reticular bonding skeleton between the pieces, formed of thin films whose thickness, as will be seen, can be regulated as desired. The slabs taken from the block are not subject to subsequent deformation as would occur by release of the internal stresses due to the hardening of the binding composition.

From the economic point of view, the method is advantageous in that, as in the production of conventional conglomerates, the starting material can be a waste stone material, of whatever type, without limitations. Although it is necessary that this material has at least two plane parallel faces, in many cases it is possible to use fragments of slabs or very defective slabs or tiles, which otherwise would not be economically recoverable, or else it is possible to use slabs cut from blocks or other defective pieces which would not find other applications. It is also possible to employ stone fragments, provided that two opposite surfaces are planed. The impregnation to the center of the block by filling all interstices and cavities, including capillary cavities, guarantees the obtaining of slabs and other final products which do not require stoppering and which only require to be subjected to polishing.

Further, the apparatus suitable for carrying out the method of the present invention is more economical than that conventionally used for the production of conglomerates, in that it does not require rugged closeable forms and the relative mechanisms for their rotation and/or vibration, and does not require costly devices for the crushing and conveying of the materials.

Finally, from the aesthetic point of view, very pleasant decorative effects can be obtained both with the geometric disposition of different pieces, and with the employment of pieces of material of different colours. Thus, instead of pieces of stone material it is possible to use, in part, pieces of most other materials.

If one wishes to obtain even more valued material, it is possible to employ pieces in the form of small squared blocks or small slabs, possibly all equal, even starting from waste materials. These pieces may be arranged e.g. as the various courses of bricks on a wall. By forming the block in a suitable way with pieces of different materials, arranged according to a predetermined pattern, a series of slabs can be obtained which show a given recurring design.

The invention also relates to the blocks obtained by the aforesaid process, as well as to finished products which can be obtained from these blocks, such as slabs, small blocks, floor tiles and the like.

The invention will be better understood from the following description, given as a non-limitative example and with reference to the accompanying drawings, in which.

To obtain a block according to the method of the invention, pieces of marble or the like used as starting material, said pieces being typically constituted by waste products of other work. The only essential requisite which these pieces must satisfy is that of having a plurality of plane faces, of which at least two are mutually parallel. These faces should preferably have a certain natural roughness, such as that obtained from grinding, sawing or similar cutting operation. A suitable material for this purpose consists of fragments of slabs or waste slabs. However, it is possible to obtain the pieces by cutting them from waste blocks or block fragments, e.g. by means of sawing on sawing frames. However, the desired pieces may be obtained from any type of stone fragments, provided that they have two plane parallel faces or that these faces are formed by a preliminary cutting or grinding operation.

Figure 1:
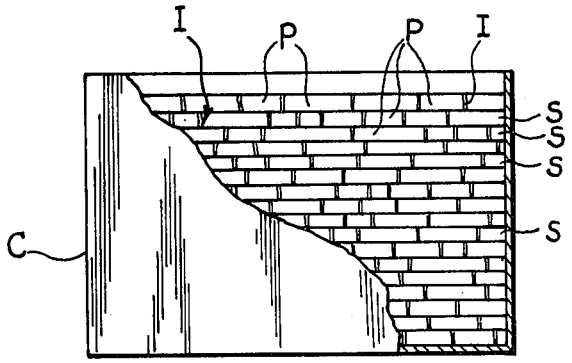
FIG. 1 shows in elevation a simple disposition of pieces forming a block, in a container one of whose walls has been partly removed.
Figure 2:
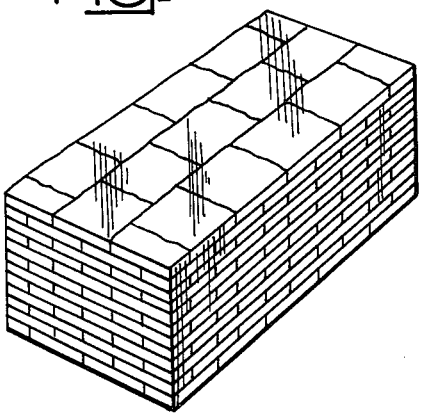
FIG. 2 is a perspective view of a possible disposition of pieces of parallelepiped form.

Referring to FIG. 1, the pieces P are arranged in a liquid-tight container C which has an open top and whose inner shape and dimensions correspond to that of the block to be obtained. The pieces P are arranged in superimposed layers S along the plane parallel faces of said pieces. In each of these layers S it is necessary that the pieces P all have the same thickness between their plane parallel faces, but such thickness can vary from one layer to the other. Further, it is useful if the pieces P are so much as possible staggered both within the same layer and from one layer to another, and this is with the aim of producing a reciprocal joint which serves to subsequently improve the cohesion of the block. This staggered disposition is shown in FIGS. 1 and 2. If one wishes to obtain a product of more valued quality from the structural point of view, and also from the aesthetic point of view, one can start from small blocks or small slabs of parallelepiped form, possibly all equal. Even in this case, waste material can form the starting materials, such as, e.g., fragments of blocks or slabs, or even very defective blocks and slabs. It is not necessary that the pieces are all of the same stone material. On the contrary, very original aesthetic effects can be obtained using differently coloured pieces and even pieces of other materials, such as wood, aluminum, copper, and also glasses and transparent and opaque plastics materials, coloured or uncoloured.

Figure 3:
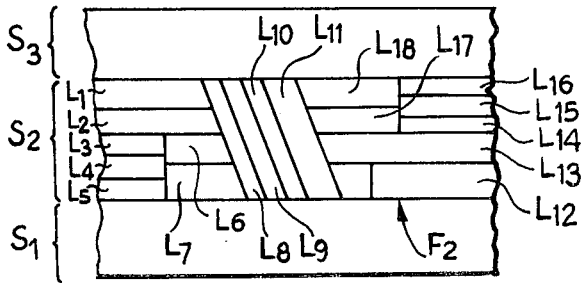
FIG. 3 is a view in fragmentary elevation of a possible more complex disposition of pieces in different layers.

Neither is it necessary that each individual layer S be formed completely of pieces having, between their plane parallel faces, a thickness equal to the thickness of the layer. Thus, FIG. 3 shows a possible composition of a layer $S_2$, formed between two layers $S_1$ and $S_3$ of non-specified composition. The layer $S_2$, as have the layers $S_1$ and $S_3$, has two plane parallel faces $F_1$, $F_2$. This layer $S_2$ comprises a plurality of plates $L_1$, $L_2$, $L_3$, $L_4$, $L_5$, $L_6$, $L_7$ placed horizontally one on the other along their plane parallel faces. The sum of the thicknesses of the plates $L_3$, $L_4$, $L_5$ is equal to that of the thicknesses of the plates $L_6$, $L_7$. As a result, the upper faces of the plates $L_3$ and $L_6$ lie in the same plane, and on this plane there are also superimposed, one after the other, the plates $L_2$ and $L_1$. The plates $L_1$, $L_2$, $L_6$ and $L_7$ have, on their right side in FIG. 3, oblique plane faces, always with the same angle and which have all been disposed in a single plane. On this oblique plane, there has been placed a series of plates $L_8$, $L_9$, $L_{10}$, $L_{11}$ juxtaposed along their plane parallel faces and whereof each has another two parallel plane faces, respectively on their upper and lower edges in FIG. 3. These latter plane parallel faces are thus oriented in such a manner that their upper face lies in the same plane $F_1$ of the plate $L_1$ and their lower face in the same plane $F_2$ of the plates $L_5$ and $L_7$. FIG. 3 shows, by way of example, an arrangement of plates $L_{12}$ to $L_{18}$, symmetrical to that of plates $L_1$ to $L_6$. As can be seen, in this case, there are pieces not only superimposed, but more generally juxtaposed along their plane parallel faces.

The concept of the arrangement of pieces along plane parallel faces may, therefore, be extended to the juxtaposition of pieces not only horizontally, but also along whatsoever inclination, up to the vertical.

In the case of pieces which, apart from their plane faces, have an irregular shape, the spaces, such as I (FIG. 1), left between one piece and another, are preferably filled with grit and/or powder, which can be of the same material as said pieces.

Further, if the plane faces are too smooth, such as e.g. in the case of fragments of already polished slabs, powder and/or fine grit, preferably of the same material as the pieces, is lightly sprinkled on the plane face of each piece, prior to it being juxtaposed with the plane face of the next piece. This serves to form between the plane faces of pieces and between one layer and another very small interstices of the order of a tenth of millimeter which, in the case of plane faces obtained by means of sawing or grinding, are instead spontaneously created due to the natural roughness of these faces. The presence of these very small interstices is necessary to permit the adhesion of the pieces to the binding composition which will be poured at a further step.

The above application of grit and/or powder can be effected to calibrate to the desired value the thickness of the interstices between the plane faces, for example, with the aim of making more striking, for aesthetic reasons, the binding composition which, as will be seen, fills these interstices. In this case, for aesthetic reasons, the binding composition can have a contrasting colour to that of the pieces.

Figure 4:
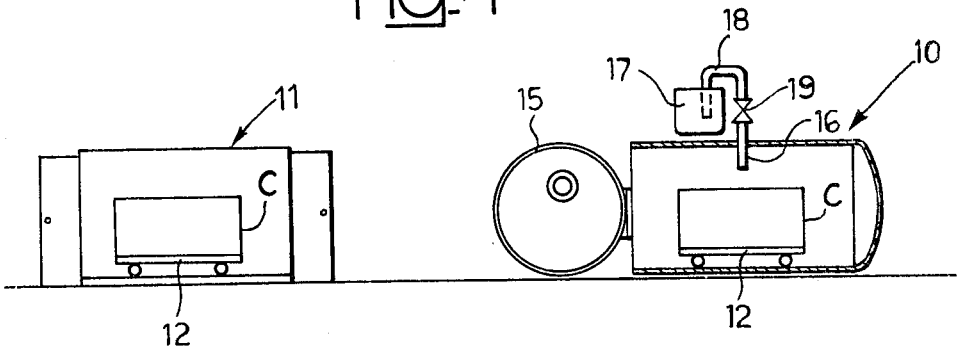
FIG. 4 is a schematic view of an apparatus for carrying out the method of the invention.

Referring to FIG. 4 there will now be described an apparatus which may be used for carrying out the method of invention.

The apparatus comprises, as fundamental component, a pressure-tight vessel, shown in the Figure as an autoclave 10.

Advantageously, although not necessarily, the apparatus also comprises a heating chamber 11.

The autoclave 10 and the chamber 11 are interconnected for example by a track (not illustrated) along which one or more trolleys 12 can be moved. On each trolley 12 there has been represented a container C in which the pieces have been disposed in the way described above. The platform of the trolley 12 can constitute the base of the container C.

The container C, full of pieces, is introduced into the heating chamber 11 where it is left for a time sufficient to heat the mass of pieces to their core, with the aim of drying them. Nevertheless, it would be possible to dry the pieces prior to putting them in the container, for example, by storing them in the chamber 11 before being loaded to the trolley or after they have been arranged on the platform of the trolley, but without the side walls of the container. It is also possible to effect a pre-drying of the pieces by passing them through a heating chamber on a conveyor belt.

After the heating has been effected, the container C with the pieces is introduced into the autoclave 10. The autoclave 10 is made pressure tight by closing its door 15, and then a vacuum is applied within the autoclave 10. This has the primary effect, due to the fact that the vapour pressure of the water is reduced, of causing or strongly favouring the evaporation of any water still present in the interstices between one piece and another and between the pieces and the walls of the container C, as well as in the surface cavities of the pieces (cracks, fractures, alveoli, etc.). The evaporation of a first part of the water had already taken place during the heating step.

To obtain a better drying, the heated pieces could also be subjected to a vacuum treatment in the autoclave 10 prior to stacking them, while maintaining them apart from one another.

The vacuum applied to the pieces and the heat which has preferably been imparted to them have the effect of rendering the whole of the pieces perfectly dry at the pouring step of the binding composition, which will be described later, because this serves to guarantee a perfect adhesion of such composition to each individual piece with consequent efficient adhesion of the pieces to one another and also of the different parts of said individual piece which could be separated by cracks, fractures and the like. Another advantage of the heating effected in the chamber 11 consists in the fact that, when vacuum is applied, the mass of the pieces itself continuously furnishes the heat necessary for balancing that substracted by evaporation and thus prevents any formation of ice in the interstices and in the cavities. Because the water vapour released in the autoclave 10 would be removed too slowly by suction through the vacuum system (not shown), in the interior of the autoclave 10 there are provided one or more cold baffles (not shown) which are connected to a cooling system and on which the water vapour released condenses as ice.

It is possible to obtain a perfect drying of the mass of pieces by applying a vacuum of 600 $mm_{Hg}$ at a temperature of 50° C, or a vacuum of 700 $mm_{Hg}$ at a temperature of 25° C.

While maintaining the autoclave 10 under vacuum, a hardenable binding composition is introduced into the container C. For this purpose, the autoclave 10 is provided with a pouring tube 16 which sealingly extends through its wall and which freely opens above the container C. The binding composition is stored in a very fluid state in a reservoir 17 at atmospheric pressure, which is provided with a dipping tube 18. The tube 18 is connected, through a valve 19, with the pouring tube 16 and the binding composition is sucked from the reservoir 17 by means of the vacuum existing in the autoclave.

If the binding composition is a hardenable resin, the deliverly of the resin under vacuum from a higher location has the advantage of permitting a complete degassing of said resin.

The binding composition flows down between one piece and the other and between the pieces and the walls the container C, until it covers the upper face of the stack of pieces.

At this point, the pouring is stopped and the vacuum is released by connecting the inside of the autoclave 10 with the atmosphere, and then the binding composition penetrates deeply into all the interstices and into all the cavities until it fills them completely.

The binding composition is then allowed to harden and provides perfect adhesion in a block of the entire stack of pieces and the stoppering of their defects. Finally, the block is removed from the container.

The excess of hardened binding composition remains on the external face of the resulting block, providing to the latter or to the slabs and other elements which are obtained therefrom, an external reinforcing and protecting coating which is very useful in the subsequent handling and processing operations.

The binding composition may consist in a resin or else in a cement binder. Thermosetting resins can be advantageously employed such as polyester and epoxy resins, preferably in the presence of a catalyst and an accelerator so as to allow their hardening at ambient temperature. These resins may be colourless, or may be such as to produce, in the hardened state, a coloration substantially equal to that of the natural colour of the stone material used, or else a coloration distinctly contrasting with that of the stone material.

In the case of a cement binder, this latter should be initially much more fluid than those normally used for the manufacture of conglomerated marbles. When using a cement binder, the preliminary drying of the pieces is not necessary.

To improve the penetration of the binding composition, a superatmospheric pressure can be applied in the autoclave 10 prior to the hardening of the binding composition.

It may also be possible to use the container C itself as a pressure-tight vessel.

The block obtained according the above described method can supply, by cutting, both slabs and other elements of whatever form, such as small blocks floor tiles and the like. Preferably, the cutting should be effected along perpendicular planes to that of the layers. Still preferably, said perpendicular planes should not coincide with the planes of junction of the pieces or better lie at some distance therefrom.

Figure 5:
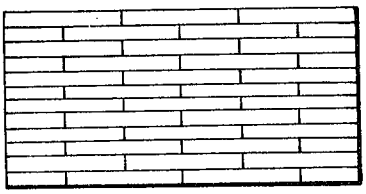
FIGS. 5 and 6 are front views of slabs obtained from blocks produced according to the invention.
Figure 6:
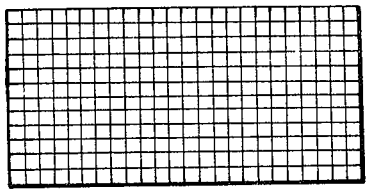

To give a concrete example of the possibilities offered by the method, with the cutting of a block as shown in FIG. 2 and possible formed of pieces of different colours, there can be obtained a plurality of slabs presenting a design such as illustrated in FIG. 5. Very pleasing aesthetic effects may be obtained by parallely rearranging these slabs one against the other in a similar container to that described above, with a disposition different from that employed for preparing the starting block, subjecting them to the above described treatment. For example, the slabs could be rearranged so that from one slab to another the pieces of squared form which compose them are staggered and from the second block thus obtained there could be cut other slabs at 90° with respect to the preceding cutting direction, thus obtaining a "mosaic" design such as illustrated in FIG. 6. This may also be effected by suitably rearranging the slabs constituting the second block.

Figure 7:
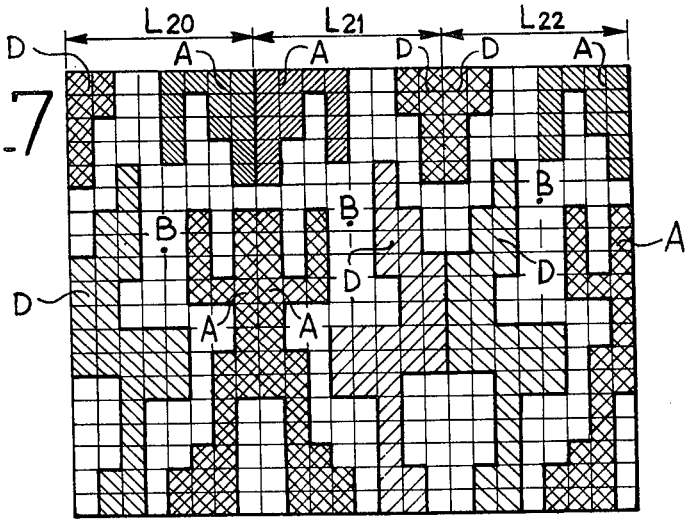
FIG. 7 is a front view of a succession of flanked slabs, which illustrates one of the very varied possibilities of formation of a recurring design.

FIG. 7 shows an example of a decorative design. Three side by side slabs $L_{20}$, $L_{21}$, $L_{22}$ are formed of "mosaic" elements of different colours and disposed according to predetermined patterns. In each slab there are dark-coloured regions A, light-coloured regions B and regions D of another colour. Since the slabs have been out at an angle of 90° with respect to the direction along which the block shows a constant cross-section such as that of $L_{21}$, they all present the same polychrome design. The slabs $L_{20}$ and $L_{22}$ are inverted with respect to the slab $L_{21}$, as a result of which there are obtained a recurring designs symmetrical about the junction line of the slabs.

I claim:

1. Method for the production of blocks from pieces of marble and similar natural stones, said method comprising the following series of steps:

a. providing a plurality of pieces of marble or similar natural stone having a plurality of plane faces, at least two of which are rough and parallel to each other;

b. stacking said pieces in a plurality of layers with a plurality of pieces in each layer in an open container having internal shape and dimensions corresponding to those of the block to be obtained and whose side walls and bottom wall are liquid-tight, said pieces within each layer having the same thickness and being arranged with their plane faces facing adjacent layers so as to form a plurality of parallel layers, each layer being delimited by a plurality of each plane faces;

c. placing said open container in a sealed autoclave and applying a vacuum in said autoclave;

d. pouring into said container, while maintaining the autoclave under vacuum, a fluid hardenable resin binding composition, so that said composition flows down through the interstices between one piece and another and between the pieces and the side walls of the container, until it completely covers said pieces;

e. bringing the inside of the autoclave to atmospheric or super-atmospheric pressure, thus causing said fluid binding composition to thoroughly penetrate into all said interstices, including those caused by the roughness of said plane faces, and into all the cavities of the pieces opening on the surface of said pieces;

f. allowing said binding composition to harden; and g. removing from said container the thus consolidated block, formed by the pieces and hardened binding composition.

2. Method according to claim 1, wherein said layers are arranged horizontally.

3. Method according to claim 1, wherein said pieces are arranged in the container so that the joints between the pieces are at least in part staggered one from the other.

4. Method according to claim 1, wherein said pieces have a substantially parallelepiped shape.

5. Method according to claim 1, wherein at least a part of said pieces consists in fragments of slabs and/or in waste slabs.

6. Method according to claim 1, wherein the interstices left between one piece and another in each layer because of their irregular shape are filled with grit and/or powder of stone material.

7. Method according to claim 1, wherein said plane faces are lightly sprinkled during stacking, with powder and/or fine grit, preferably of the same materials as that of said pieces, prior to placing successive pieces thereagainst.

8. Method according to claim 1, and further comprising the following series of steps:

h. cutting said consolidated block along mutually parallel planes perpendicular to the direction of said layers, so as to obtain a plurality of pieces in the form of slabs substantially of the same thickness;

i. re-arranging said pieces in the form of slabs parallel one to the serial other, so as to obtain a disposition different from that shown in the block from which they have been cut, in a container similar to that used in step (b); and repeating the steps (c), (d), (e), (f) and (g).

9. Method according to claim 1, wherein said pieces are heated prior or after their placement in said container and prior to applying the vacuum.

10. Method according to claim 1, wherein, in addition to pieces of marble or similar natural stones, there are used pieces of materials different from natural stones, which are similar in shape to said pieces of marble or similar natural stone.

* * * * *